US006273012B1

(12) United States Patent
Hattori et al.

(10) Patent No.: US 6,273,012 B1
(45) Date of Patent: Aug. 14, 2001

(54) HEADGEAR FRAME APPARATUS

(75) Inventors: Osamu Hattori; Masahiko Ozeki, both of Ichinomiya (JP)

(73) Assignee: Kabushikikaisha Barudan, Ichinomiya (JP)

( * ) Notice: Subject to any disclaimer, the term of this patent is extended or adjusted under 35 U.S.C. 154(b) by 0 days.

(21) Appl. No.: 09/537,220

(22) Filed: Mar. 29, 2000

(30) Foreign Application Priority Data

Mar. 30, 1999 (JP) ..... 11-127519
Apr. 14, 1999 (JP) ..... 11-106172
Apr. 30, 1999 (JP) ..... 11-125175

(51) Int. Cl.[7] ..... D05C 9/04
(52) U.S. Cl. ..... 112/103; 112/470.18
(58) Field of Search ..... 112/103, 470.06, 112/470.09, 470.14, 475.11, 63, 470.18

(56) References Cited

U.S. PATENT DOCUMENTS 5,701,831 * 12/1997 Morita ..... 112/103
6,119,609 * 9/2000 Kawaguchi et al. ..... 112/103

* cited by examiner

*Primary Examiner*—Peter Nerbun
(74) *Attorney, Agent, or Firm*—Pillsbury Winthrop LLP

(57) ABSTRACT

A headgear frame apparatus comprises: a headgear frame for clamping a headgear; a rotary drive frame for fitting the headgear frame replaceably thereon on the side of a sewing machine; a horizontal drive frame for applying a rotation and a longitudinal drive to the rotary drive frame through a medium including a wire; and a support frame engaging in a relative displacement with the horizontal drive frame for supporting the rotary drive frame rotatably. The support frame is constructed to include a front side member positioned on the front side of the horizontal drive frame and a back side member positioned on the back side of the horizontal drive frame. The front side member and back side member are jointed such that the horizontal drive frame is clamped between one or more front side bearing roller mounted rotatably on the front side member and one or more back side bearing roller mounted rotatably on the back side member.

9 Claims, 12 Drawing Sheets

HEADGEAR FRAME APPARATUS

BACKGROUND OF THE INVENTION

1. Field of the Invention

The present invention relates to a headgear frame apparatus of a sewing machine for embroidering a headgear.

2. Description of the Related Art

As shown in FIGS. 10 and 11, a first conventional headgear frame apparatus 105 is provided with: a headgear frame 100 for clamping a headgear 1; a rotary drive frame 106 for fitting said headgear frame 100 replaceably thereon on the side of a sewing machine; a support frame 109 for supporting said rotary drive frame 106 rotatably; and a guide plate 110 fixed on said support frame 109 and extending to the side of a cylindrical bed 111 of the sewing machine.

When the support frame 109 is to be mounted on the sewing machine, a mounting bracket 113 is fixed on the upper face of a horizontal drive frame (or a pantograph) 112. On the back face of the bracket 113, there is mounted a rotary drive slide rail 114 having a rail groove 114*a*, in which the support frame 109 is fitted through bearing rollers 115.

According to this structure, however, the support frame 109 can be easily mounted, but a clearance 116 is necessarily required between the rail groove 114*a* and the bearing rollers 115. This clearance 116 leaves a longitudinal looseness to affect the embroidery adversely. At a high speed (e.g., 750 rpm), moreover, the headgear frame 100 oscillates vertically to break the needle frequently or to blot the finish of the embroidery.

As shown in FIG. 12, on the other hand, a second conventional headgear frame apparatus 150 is provided with: a guide rail 151*a* projected below the root and end portion of a cylindrical bed 151 in parallel with the cylindrical bed 151; a support frame 153 supported slidably along said guide rail 151*a* and rotatably supporting a rotary drive frame 152 fitting the (not-shown) headgear frame replaceably thereon for clamping the headgear; a transmission mechanism 154 for transmitting a driving force to the rotary drive frame 152; and a horizontal drive frame 155 for driving the rotary drive frame 152 longitudinally through the support frame 153 and for driving the rotary drive frame 152 rotationally through the transmission mechanism 154.

The support frame 153 is composed of a front side member 153*a* positioned on the front side of the horizontal drive frame 155, and a back side member 153*b* positioned on the back side of the horizontal drive frame 155. The back side member 153*b* is jointed to the front side member 153*a* through joint screws 153*c*.

By loosening the joint screws 153*c* to remove the back side member 153*b* from the front side member 153*a* and by removing a joint member 156 joining the transmission mechanism 154 and the horizontal drive frame 155, moreover, the support frame 153, the rotary drive frame 152 and the transmission mechanism 154 can be removed from the horizontal drive frame 155.

The transmission mechanism 154 is provided with a base member 157 joined to the horizontal drive frame 155 by the joint member 156 and extending transversely, and a wire 158 wound by one turn on the circumferential wall of the rotary drive frame 152 and fixed at both end portions, individually, on the left and right end portions of the base member 157. The wire 158 is fixed at its generally intermediate portion on the circumference wall of the lower end side of the rotary drive frame 152 through a clamping member 159 so that when the horizontal drive frame 155 is moved transversely, the rotation is applied to the rotary drive frame 152 through the wire 158.

In order to transport the sewing machine, to replace the headgear frame apparatus 150 by a holding frame for working a cylindrical cloth other than the headgear or to replace the headgear frame apparatus 150 suitably according to the headgear 1, this headgear frame apparatus 150 is constructed such that when the joint member 156 is removed, the support frame 153, the rotary drive frame 152 and the transmission mechanism 154 can be removed from the horizontal drive frame 155.

After these removals, however, there arises a problem that the base member 157 of the transmission mechanism 154 is brought into an unstable state where it is connected to the rotary drive frame 152 through the wire 158.

SUMMARY OF THE INVENTION

A first object of the invention is to provide a headgear frame apparatus which can be mounted without any looseness on a horizontal drive frame.

A second object of the invention is to provide a headgear frame apparatus which can prevent a support frame and a transmission mechanism from being disintegrated, when the support frame, a rotary drive frame and the transmission mechanism are removed from the horizontal drive frame.

A third object of the invention is to provide a headgear frame apparatus which can be mounted without any looseness on a horizontal drive frame and which can prevent a support frame and a transmission mechanism from being disintegrated, when the support frame, a rotary drive frame and the transmission mechanism are removed from the horizontal drive frame.

In the first headgear frame apparatus for a sewing machine of a first aspect of the invention, therefore, there are taken the following means, as will be individually described with reference to FIGS. 1 to 4.

According to the first aspect of the invention, there is provided a headgear frame apparatus 9 comprising: a headgear frame 10 for clamping a headgear 1; a rotary drive frame 30 for fitting said headgear frame 10 replaceably thereon on the side of a sewing machine; a horizontal drive frame 60 for applying a rotation and a longitudinal drive to said rotary drive frame 30 through a medium such as a wire 61; and a support frame 40 engaging in a relative displacement with said horizontal drive frame 60 for supporting the rotary drive frame 30 rotatably, characterized:

in that the support frame 40 is constructed to include a front side member 47 positioned on the front side of the horizontal drive frame 60 and a back side member 48 positioned on the back side of the horizontal drive frame 60; and in that the front side member 47 and the back side member 48 are jointed such that the horizontal drive frame 60 is clamped between one or more front side bearing roller 49 mounted rotatably on the front side member 47 and one or more back side bearing rollers 50 mounted rotatably on the back side member 48.

The headgear 1 includes a cap, a hat, a beret and any others which can be embroidered and worn on the head.

There can be exemplified a mode in which the front side member 47 and the back side member 48 are joined by inserting one or more joint screws 52 which are screwed in one of them (e.g., the front side member 47 in the shown embodiment) into one or more U-grooves 51 formed in the other (e.g., the back side member 48 in the shown embodiment), and by fastening said joint screw 52.

There can also be exemplified either a mode in which one of the front side bearing roller 49 and the back side bearing roller 50 is one whereas the other is two (to provide the so-called "three-point support" without any looseness) or a mode in which both of them are two or more. In the shown embodiment, the front side bearing rollers 49 are provided by two whereas the back side bearing roller 50 is provided by one.

The support frame 40 is mounted in the following manner:

The front side member 47 is mounted in front of the horizontal drive frame 60;

The back side member 48 is inserted horizontally from the back side of the horizontal drive frame 60 below the horizontal drive frame 60 toward the front side member 47;

At this time, the joint screws 52 are inserted in the U-grooves 51 at the leading end portions of the back side member 48. In this state, the horizontal drive frame 60 (at its front face and back face) is clamped between the front side bearing rollers 49 and the back side bearing roller 50; and In this clamped state, the joint screws 52 are fastened cautioning not to form any clearance (or looseness) between the horizontal drive frame 60 and the individual bearing rollers 49 and 50.

The following effects can be achieved according to this headgear frame apparatus 9:

Since the longitudinal driving force of the headgear frame 10 is given directly (without any looseness) from the horizontal drive frame 60, the headgear frame 10 has low longitudinal vibration at a high speed (e.g., 800 rpm); and Because of this low vibration at a high speed, the longitudinal step-out of the headgear frame 10 is suppressed so that the embroidering operation can be performed at a high speed to finish the embroidered pattern decoratively.

According to a second aspect of the invention, on the other hand, there is provided a headgear frame apparatus comprising: a support frame for rotatably supporting a rotary drive frame for fitting a headgear frame for clamping a headgear replaceably thereon; a transmission mechanism for transmitting a driving force to said rotary drive frame; and a horizontal drive frame for driving said rotary drive frame longitudinally through said support frame and for driving said rotary drive frame rotationally though said transmission mechanism, so that said support frame, said rotary drive frame and said transmission mechanism can be removed from said horizontal drive frame when one or more joint members having a function to join said transmission mechanism and said horizontal drive frame is removed, characterized by further comprising a temporary connecting member having a function to connect said support frame and said transmission mechanism removably while substantially holding a positional relation between said support frame and said transmission mechanism so that said support fame and said transmission mechanism may not be disconnected.

Here, the headgear includes a cap, a hat, a beret and any others which can be embroidered and worn on the head.

The headgear frame apparatus can be constructed such that when one of said temporary connecting member and said joint member performs said function, the other does not perform said function.

In another exemplified mode, the headgear frame apparatus can be constructed: such that said joint member includes a joint stem adapted to be inserted into a first joint hole formed in said transmission mechanism and a second joint hole formed in said horizontal drive frame; such that said temporary connecting member includes a connecting stem adapted to be inserted into a first connecting hole formed in said transmission mechanism and a second connecting hole formed in said support frame; such that when the joint stem of said joint member is inserted in said first joint hole and said second joint hole, said first connecting hole and said second connecting hole are misaligned so that the connecting stem of said temporary connecting member cannot be inserted in them; and such that when the connecting stem of said temporary connecting member is inserted into said first connecting hole and said second connecting hole, said first joint hole and said second joint hole are misaligned so that the joint stem of said joint member cannot be inserted in them.

According to a third aspect of the invention, on the other hand, there is provided a headgear frame apparatus comprising: a headgear frame for clamping a headgear; a rotary drive frame for fitting said headgear frame replaceably thereon on the side of a sewing machine; a horizontal drive frame for applying a rotation and a longitudinal drive to said rotary drive frame through a transmission mechanism; and a support frame engaging in a relative displacement with said horizontal drive frame for supporting said rotary drive frame rotatably, characterized: in that said support frame is constructed to include a front side member positioned on the front side of said horizontal drive frame and a back side member positioned on the back side of said horizontal drive frame; in that the front side member and the back side member are joined by one or more joint members such that said horizontal drive frame is clamped between one or more front side bearing rollers mounted rotatably on said front side member and one or more back side bearing rollers mounted rotatably on said back side member; in that said support frame, said rotary drive frame and said transmission mechanism can be removed from said horizontal drive frame when one or more joint members having a function to join said transmission mechanism and said horizontal drive frame and said joint member are removed; and in that there is further comprised a temporary connecting member having a function to connect said support frame and said transmission mechanism removably while substantially holding a positional relation between said support frame and said transmission mechanism so that said support frame and said transmission mechanism may not be disconnected.

Further objects of this invention will become evident upon an understanding of the illustrative embodiments described below. Various advantages not specifically referred to herein but within the scope of the instant invention will occur to one skilled in the art upon practice of the presently disclosed invention. The following examples and embodiments are illustrative and not seen to limit the scope of the invention.

DETAILED DESCRIPTION OF THE PREFERRED EMBODIMENTS

Figure 1:
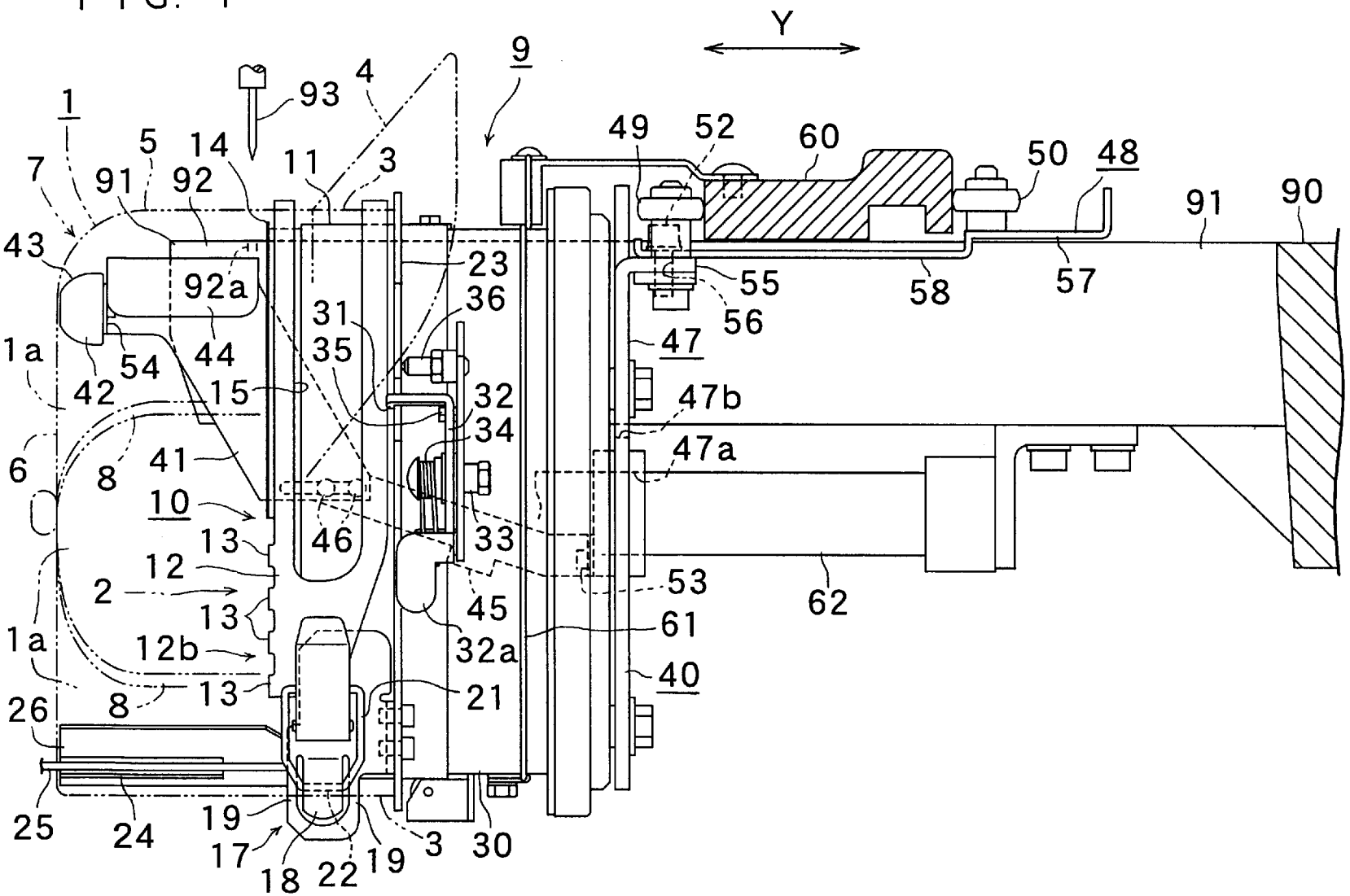
FIG. 1 is a righthand side view showing a headgear frame apparatus for a sewing machine according to a first embodiment of the invention.
Figure 2:
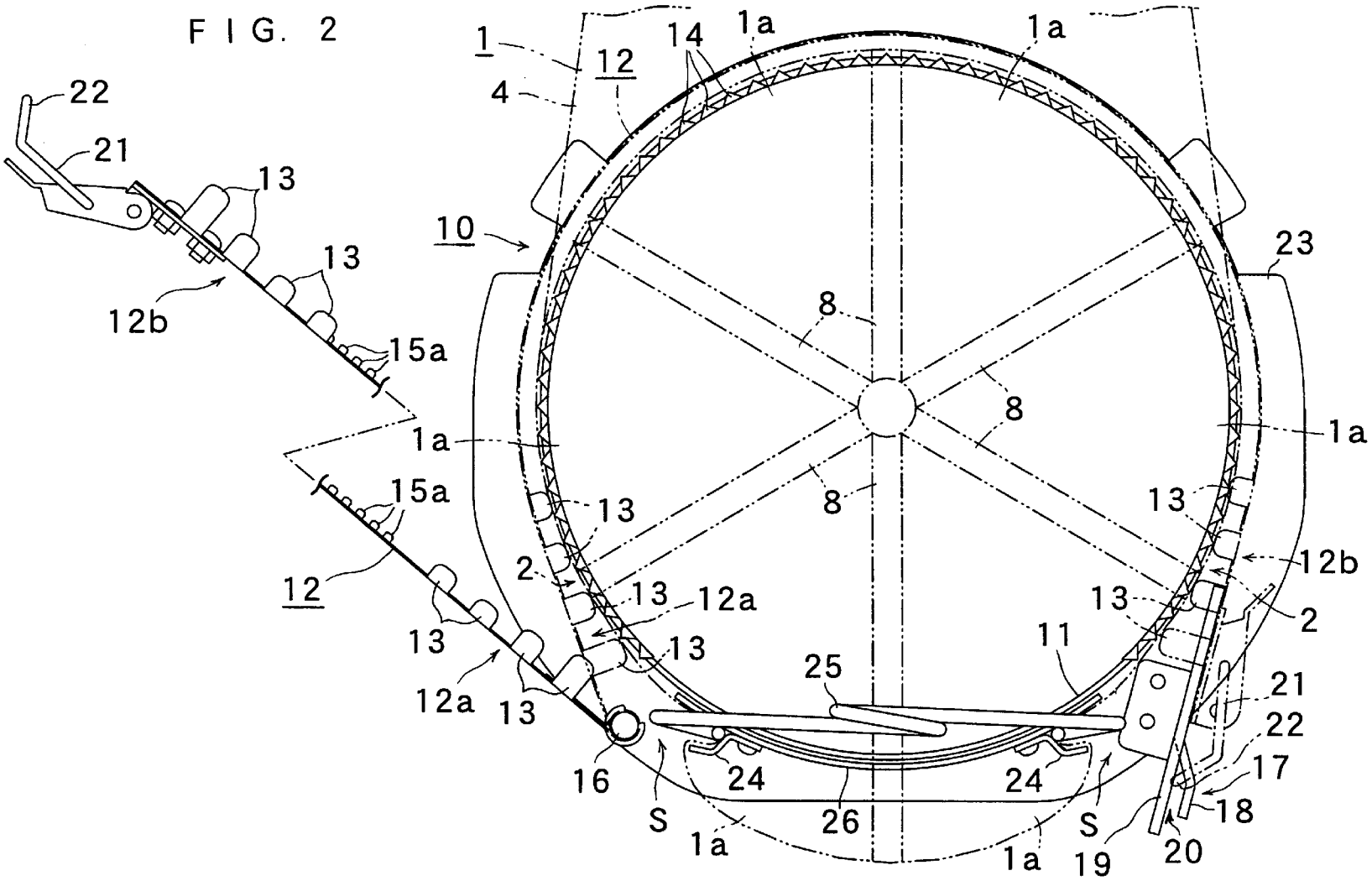
FIG. 2 is a front view of a headgear frame of the same headgear frame apparatus.
Figure 3:
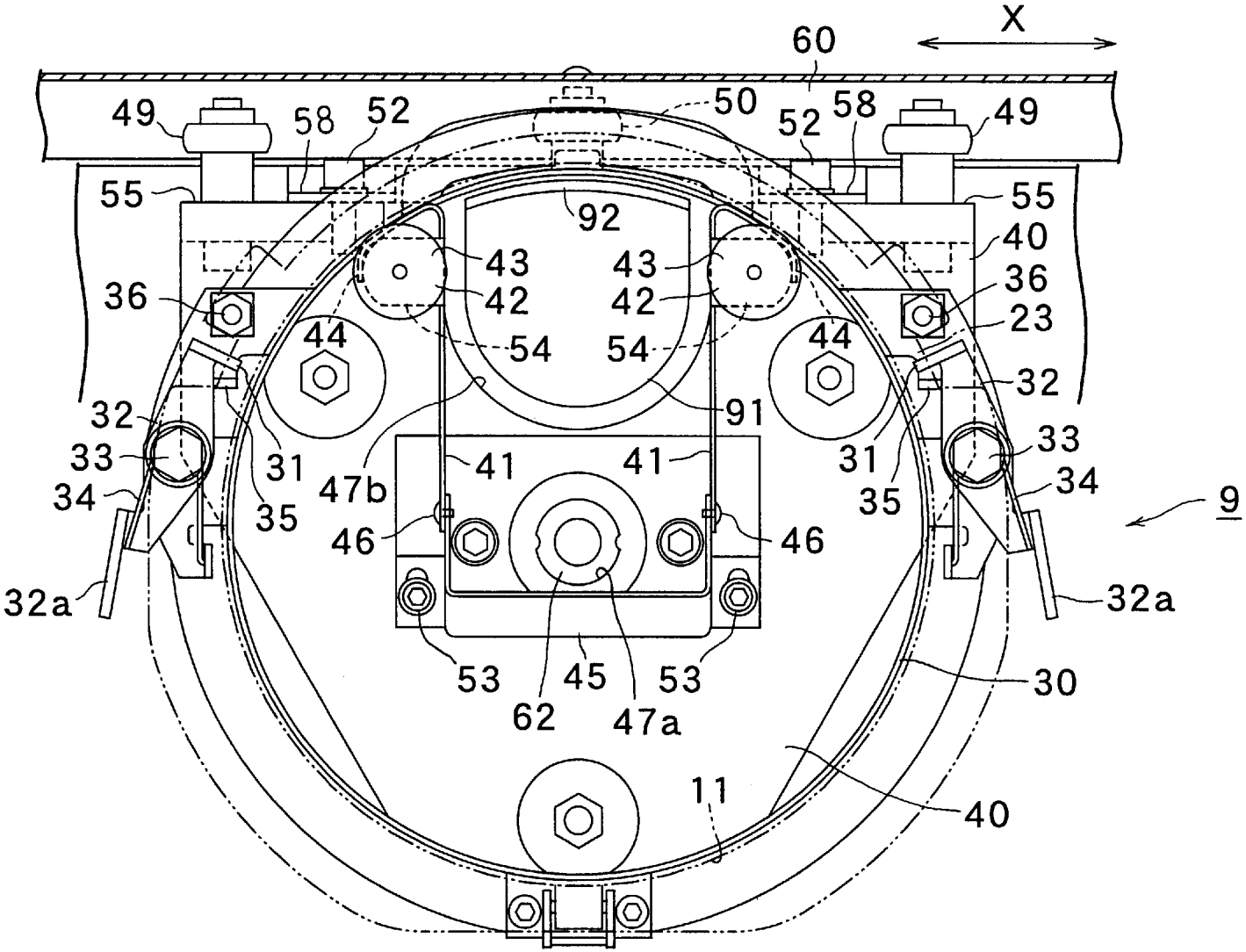
FIG. 3 is a front view of the same headgear frame apparatus.
Figure 4:
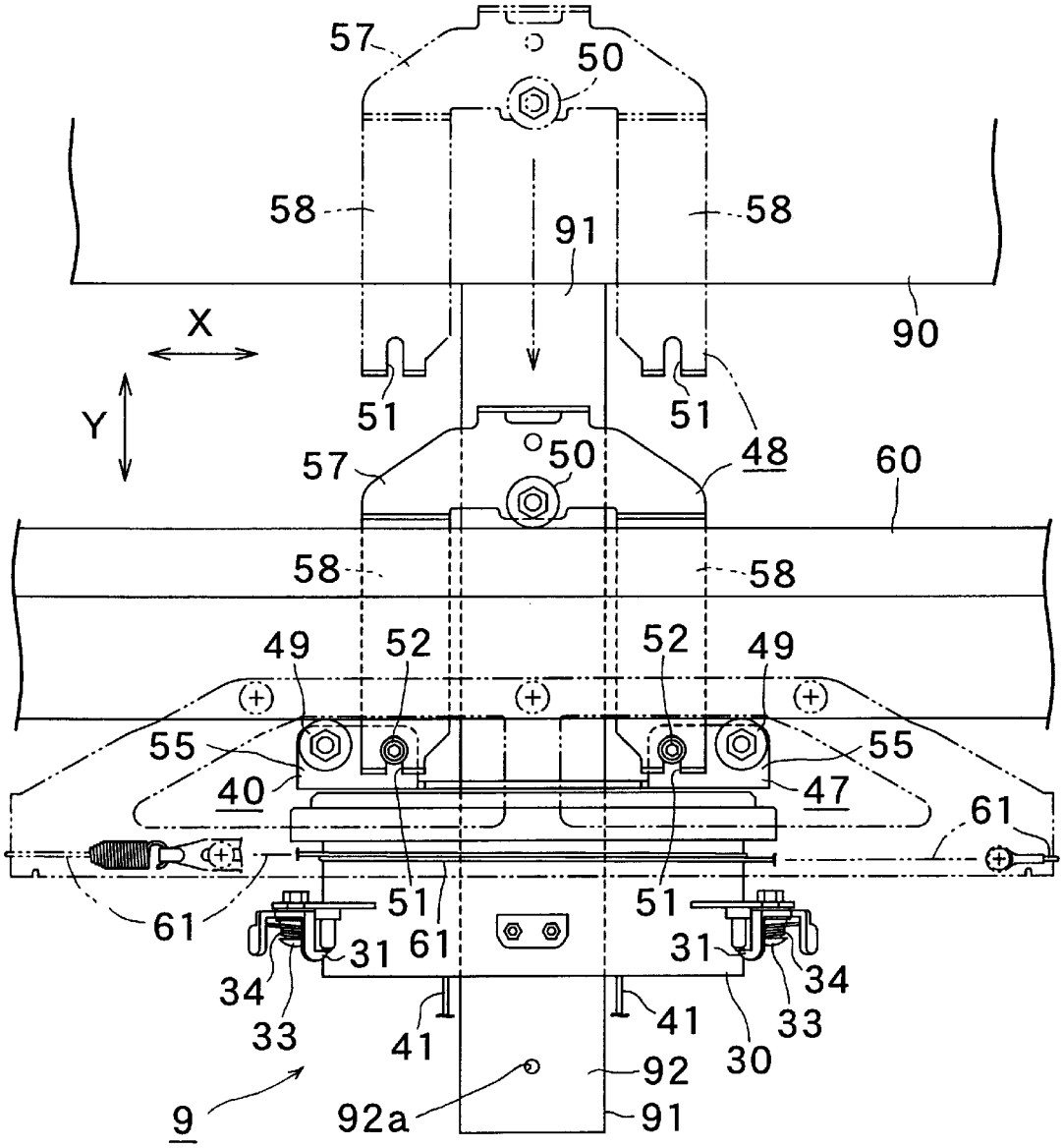
FIG. 4 is a top plan view of the same headgear frame apparatus.

FIGS. 1 to 4 show a headgear frame apparatus 9 for a sewing machine according to a first embodiment of the invention. As shown in FIG. 1, this sewing machine is provided with a cylindrical bed 91 which is projected in parallel with a direction, as indicated by arrow Y, from a machine frame 90. Below and in parallel with the root end side of the cylindrical bed 91, there is projected a guide rail 62 which supports a headgear frame apparatus 9 including the headgear frame 10 in a manner to move in the direction Y. Over the cylindrical bed 91, there is further provided a horizontal drive frame 60 which extends in a horizontal plane in the direction X, as shown in FIG. 3, intersecting the direction Y at a right angle, so that the headgear frame apparatus 9 is moved by the horizontal drive frame 60.

On the upper face of the leading end side of the cylindrical bed 91, there is arranged a throat plate 92 which is provided with a needle eye 92*a* and below which there is packaged a (not-shown) hook wound with a bobbin thread. Over the cylindrical bed 91, there is provided a needle 93 which is made vertically movable in the (not-shown) machine head. And, a headgear (cap) 1, as held on the headgear frame apparatus 9, is embroidered by the association between the needle 93 to be driven on the basis of embroidering data and the aforementioned hook.

The headgear frame apparatus 9 is provided for supporting the embroidering range of the headgear 1 in a proper position just over the cylindrical bed 91. The headgear frame apparatus 9 is constructed to include: a support frame 40 engaging in a relative displacement with the horizontal drive frame 60 and made slidable in the direction Y along the guide rail 62; a rotary drive frame 30 so supported on the support frame 40 as to rotate on an axis parallel to the direction Y; the headgear frame 10 clamping the headgear 1 and replaceably engaged to outside of the rotary drive frame 30; elastic plates 41 mounted on a stay 45, as projected forward from the support frame 40, and extended sideways (to the left and right sides in the shown embodiment) of the cylindrical bed 91; and auxiliary rollers 42 provided rotatably at the leading ends of the elastic plate 41 and rotating in abutment against a boundary corner portion 7 between a circumferential portion 5 and a crest portion 6 of the headgear 1 clamped by the headgear frame 10.

This headgear frame 10 is provided, as shown in FIGS. 1 and 2, with a cylindrical receiving frame 11 to be inserted into the headgear 1, and a holding band 12 adapted to be wound on the outer side of the headgear 1 to clamp the headgear 1 between itself and the receiving frame 11.

The rotary drive frame 30 is given a rotation through a wire 61 and a longitudinal drive by the horizontal drive frame 60.

The support frame 40 is constructed to include a front side member 47, as positioned on the front side of the horizontal drive frame 60, and a back side member 48 positioned on the back side of the horizontal drive frame 60.

The front side member 47 is provided with: a guide hole 47*a* in which the guide rail 62 is slidably fitted; a bed hole 47*b* into which the cylindrical bed 91 is inserted; and a pair of horizontal plate portions 55 which are bent horizontally at their upper end sides on both sides of the cylindrical bed 91. Each horizontal plate portion 55 is provided with a front side bearing roller 49 which is made rotatably in a horizontal plane, and a threaded hole 56 in which a joint screw 52 for joining the back side member 48 is screwed.

The back side member 48 is composed of a base plate portion 57 extending in the direction X, and a pair of joint plate portions 58 extending in the direction Y from both end portions of the base 4 plate portion 57 on both sides of the cylindrical bed 91 and below the horizontal drive frame 60. At the center of the base plate portion 57 in the direction X, there is disposed one back side bearing roller 50 which is made rotatable in a horizontal plane. In the leading ends of the joint plate portions 58, there are formed U-grooves 51 in which the joint screws 52 screwed in the horizontal plate portions 55 of the front side member 47 can be inserted.

The front side member 47 and the back side member 48 are joined by inserting the joint screws 52 screwed in the front side member 47 into the U-grooves 51 formed in the back side member 48 and by fastening said joint screws 52.

Thus, the front side member 47 and the back side member 48 are joined such that the horizontal drive frame 60 is sandwiched between the two front side bearing rollers 49 of the front side member 47 and the single back side bearing roller 50 of the back side member 48 (in the so-called "three-point support" having no looseness).

The support frame 40 is mounted in the following manner:

(1) The guide rail 62 is inserted into the guide hole 47*a*, and the cylindrical bed 91 is inserted into the bed hole 47*b* to mount the front side member 47 in front of the horizontal drive frame 60;

(2) The back side member 48 is inserted horizontally from the back side of the horizontal drive frame 60 below the horizontal drive frame 60 toward the front side member 47;

(3) At this time, the joint screws 52 are inserted in the U-grooves 51 at the leading end portions of the back side member 48. In this state, the horizontal drive frame 60 (at its front face and back face) is clamped between the front side bearing rollers 49 and the back side bearing roller 50; and (4) In this clamped state, the joint screws 52 are fastened cautioning not to form any clearance (or looseness) between the horizontal drive frame 60 and the individual bearing rollers 49 and 50.

(a) Since the longitudinal driving force of the headgear frame 10 is given directly (without any looseness) from the horizontal drive frame 60, the headgear frame 10 has low longitudinal vibration at a high speed (e.g., 800 rpm); and (b) Because of this low vibration at a high speed, the longitudinal step-out of the headgear frame 10 is suppressed so that the embroidering operation can be performed at a high speed to finish the embroidered pattern decoratively.

Here, the invention should not be limited to the aforementioned construction of the embodiment but could be embodied by making suitable modifications within the gist thereof, as exemplified in the following:

(1) The joint screws 52 screwed in the back side member 48 are inserted into the U-grooves 51 formed in the front side member 47, and the joint is made by fastening said joint screws 52; and (2) There are provided one front side bearing roller 49 and two back side bearing rollers 50. Alternatively, there are provided two front side bearing rollers 49 and two back side bearing rollers 50.

Figure 5:
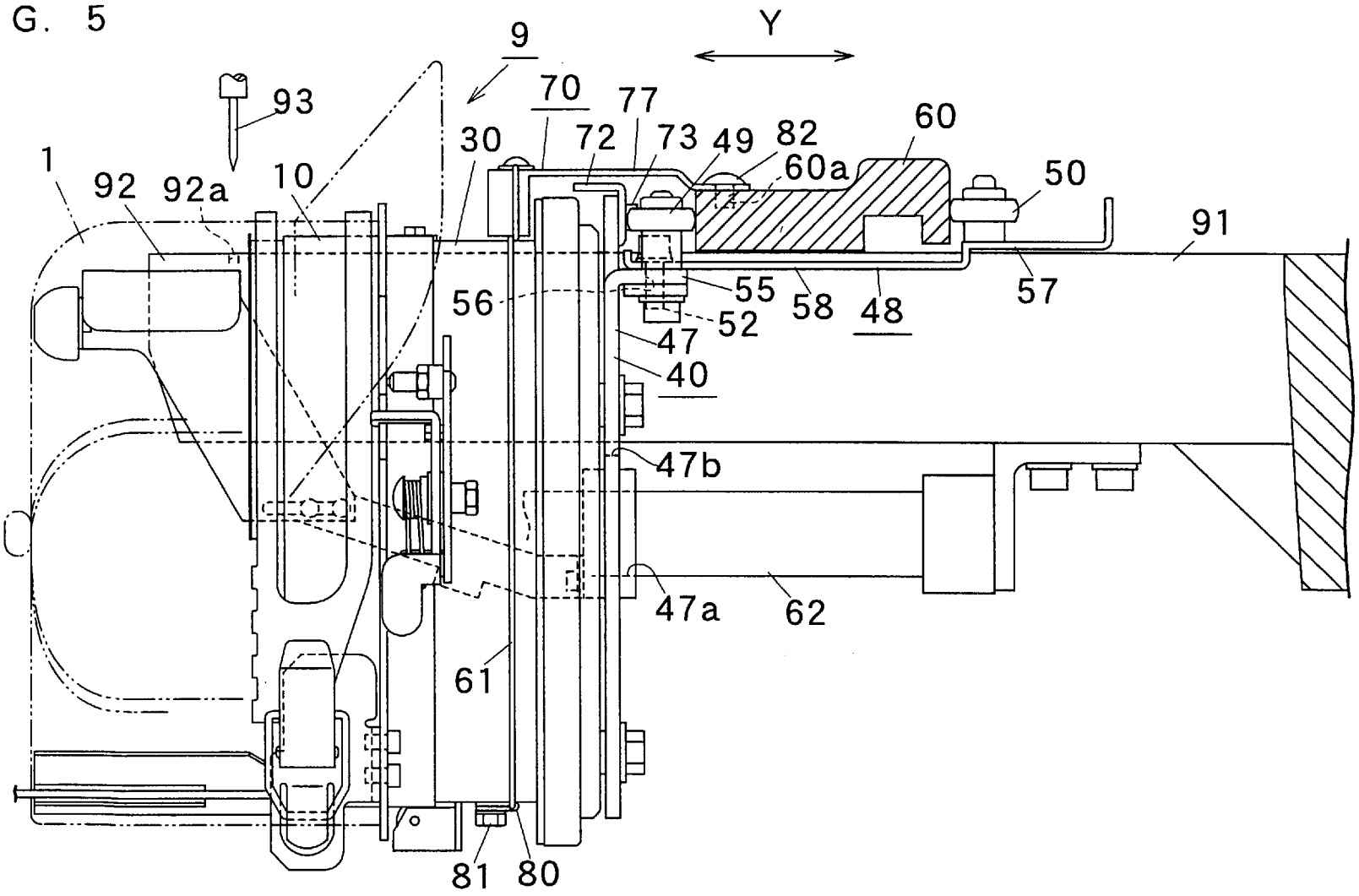
FIG. 5 is a righthand side view showing a headgear frame apparatus according to a second embodiment of the invention.

Next, FIGS. 5 to 9 show a headgear frame apparatus 9 for a sewing machine according to a second embodiment of the invention. As shown in FIG. 5, this sewing machine is provided with a cylindrical bed 91 which is projected in parallel in the arrow direction Y from a machine frame 90. The headgear frame apparatus 9 is provided for supporting the embroidering range of a headgear (cap) 1 in a proper position just over the cylindrical bed 91, and is provided with: a guide rail 62 projected in parallel with the cylindrical bed 91 below the root end side of the cylindrical bed 91; a support frame 40 supported slidably along said guide rail 62 and supporting rotatably a rotary drive frame 30 fitting a headgear frame 10 for clamping the headgear 1 replaceably thereon; a transmission mechanism 70 for transmitting a drive force to the rotary drive frame 30; and a horizontal drive frame 60 extending in the direction X for driving the rotary drive frame 30 in the direction Y through the support frame 40 and the rotary drive frame 30 rotationally through the transmission mechanism 70.

On the upper face of the leading end side of the cylindrical bed 91, there is arranged a throat plate 92 which is provided with a needle eye 92*a* and below which there is packaged a (not-shown) hook wound with a bobbin thread. Over the cylindrical bed 91, there is provided a needle 93 which is made vertically movable in the (not-shown) machine head. And, the headgear 1, as held on the headgear frame apparatus 9, is embroidered by the association between the needle 93 to be driven on the basis of embroidering data and the aforementioned hook.

The support frame 40 is constructed to include a front side member 47 positioned on the front side of the horizontal drive frame 60, and a back side member 48 positioned on the back side of the horizontal drive frame 60.

The front side member 47 is provided with: a guide hole 47*a* into which the guide rail 62 is slidably inserted; a bed hole 47*b* into which the cylindrical bed 91 is fitted; and a pair of horizontal plate portions 55 which are bent horizontally on the upper end sides at both sides of the cylindrical bed 91. Each horizontal plate portion 55 is provided with a front side bearing roller 49 which is made rotatable in a horizontal plane, and a threaded hole 56 in which a joint screw 52 for jointing the back side member 48 is screwed.

On the upper end portion of the front side member 47 over the cylindrical bed 91, there is fixed by a bolt 73 a mounting member 72 which is provided with a generally horizontal upper face. In the upper face of the mounting member 72, there is formed a second internally threaded connecting hole 72*a* which extends vertically through the mounting member 72. In this second connecting hole 72*a*, there is inserted a temporary connecting member 75, as will be described hereinafter.

The back side member 48 is composed of a base plate portion 57 extending in the direction X, and a pair of joint plate portions 58 which extend in the direction Y from both end portions of the base plate portion 57 on both sides of the cylindrical bed 91 and below the horizontal drive frame 60. At the center of the base plate portion 57 in direction X, there is disposed one back side bearing roller 50 which is made rotatable in a horizontal plane. In the leading ends of the joint plate portions 58, there are formed U-grooves 51 in which the joint screws 52 screwed in the horizontal plate portions 55 of the front side member 47 can be inserted. The front side member 47 and the back side member 48 are jointed by inserting the joint screws 52 screwed in the front side member 47 into the U-grooves 51 formed in the back side member 48 and by fastening said joint screws 52.

The transmission mechanism 70 is provided with a base member 77 connected to the horizontal drive frame 60 and extending transversely, and a wire 61 wound one turn on the circumferential wall of the rotary drive frame 30 and fixed at its both end portions, respectively, on the left and right end portions of the base member 77. The wire 61 is fixed at its generally intermediate portion on the circumferential wall on the lower end side of the rotary drive frame 30 through a clamping member 80 by a bolt 81. When the horizontal drive frame 60 moves transversely, moreover, the rotation is fed to the rotary drive frame 30 through the wire 61.

Generally at the center of the base member 77, there is formed a first connecting hole 77*a* into which an externally threaded stem 75*a* of the later-described temporary connecting member 75 is inserted. On the back side of the base member 77, there are formed three first joint holes 77*b* which are spaced transversely equidistantly. The base member 77 is removably connected to the horizontal drive frame 60 by joint members 82 which are individually fitted in the first joint holes 77*b*.

The joint member 82 is an externally threaded member having an externally threaded stem 82*a* acting as a connecting stem portion which is inserted into the first joint hole 77*b* formed in the base member 77 of the transmission mechanism 70 and which is screwed (or inserted) into a second internally threaded joint hole 60*a* formed in the horizontal drive frame 60. When the joint screw 52 is loosened to remove the back side member 48 from the front side member 47 and when the joint member 82 is removed to remove the transmission mechanism 70 from the horizontal drive frame 60, moreover, the support frame 40, the rotary drive frame 30 and the transmission mechanism 70 can be removed from the horizontal drive frame 60.

Figure 6:
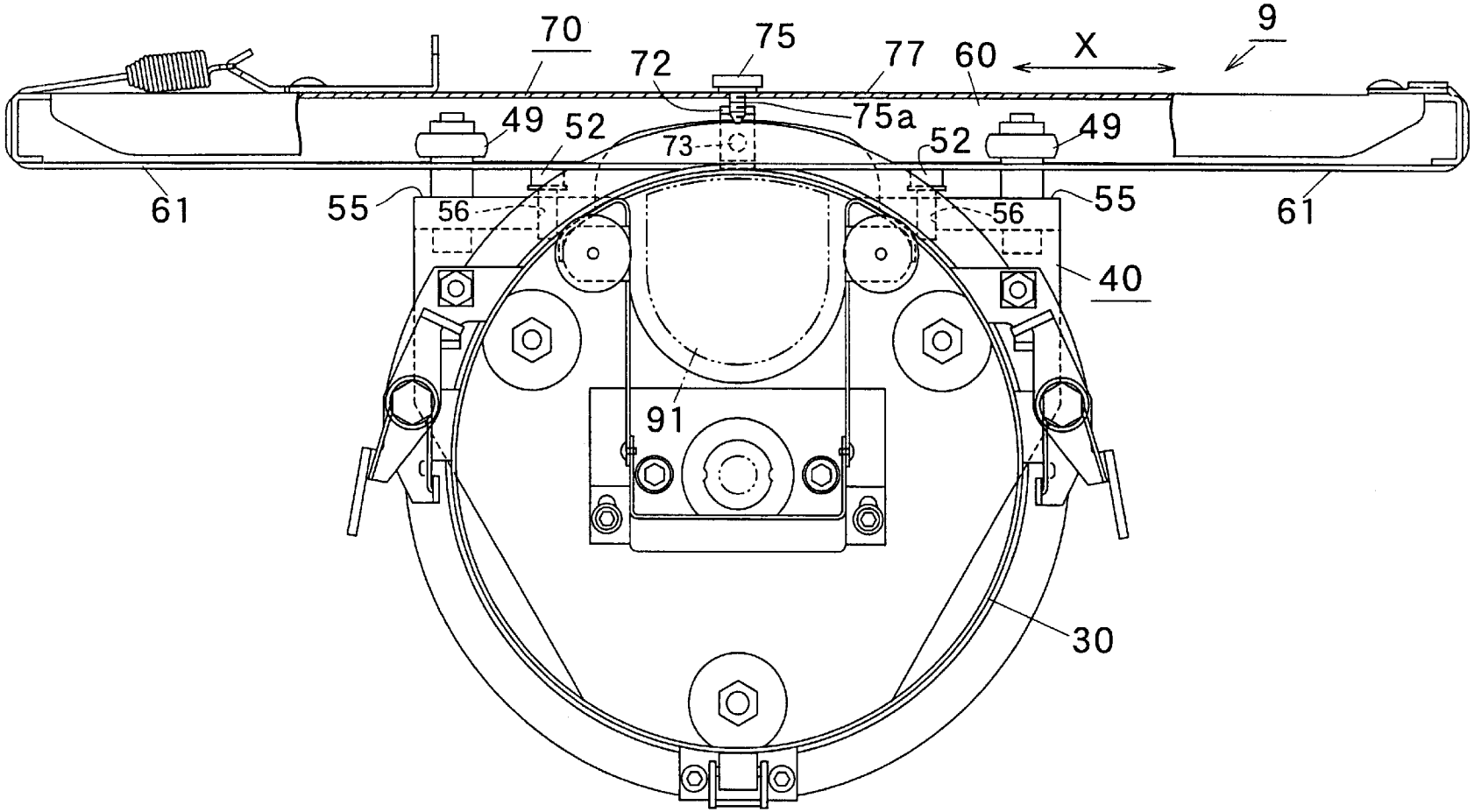
FIG. 6 is a front view of the same headgear frame apparatus.

When removed from the horizontal drive frame 60, the base member 77 of the transmission mechanism 70 is just connected to the rotary drive frame 30 by the wire 61. By fixing the transmission mechanism 70 and the support frame 40 by the temporary connecting member 75, as shown in FIG. 6, the support frame 40 and the transmission mechanism 70 are so integrally connected while substantially retaining their positional relation. This temporary connecting member 75 is an externally threaded member with a knob having the externally threaded stem 75*a* acting as the connecting stem portion which is inserted into the first connecting hole 77*a* formed in the base member 77 and which is screwed (or inserted) into the second connecting hole 72*a* formed in the mounting member 72 of the support frame 40.

Figure 7:
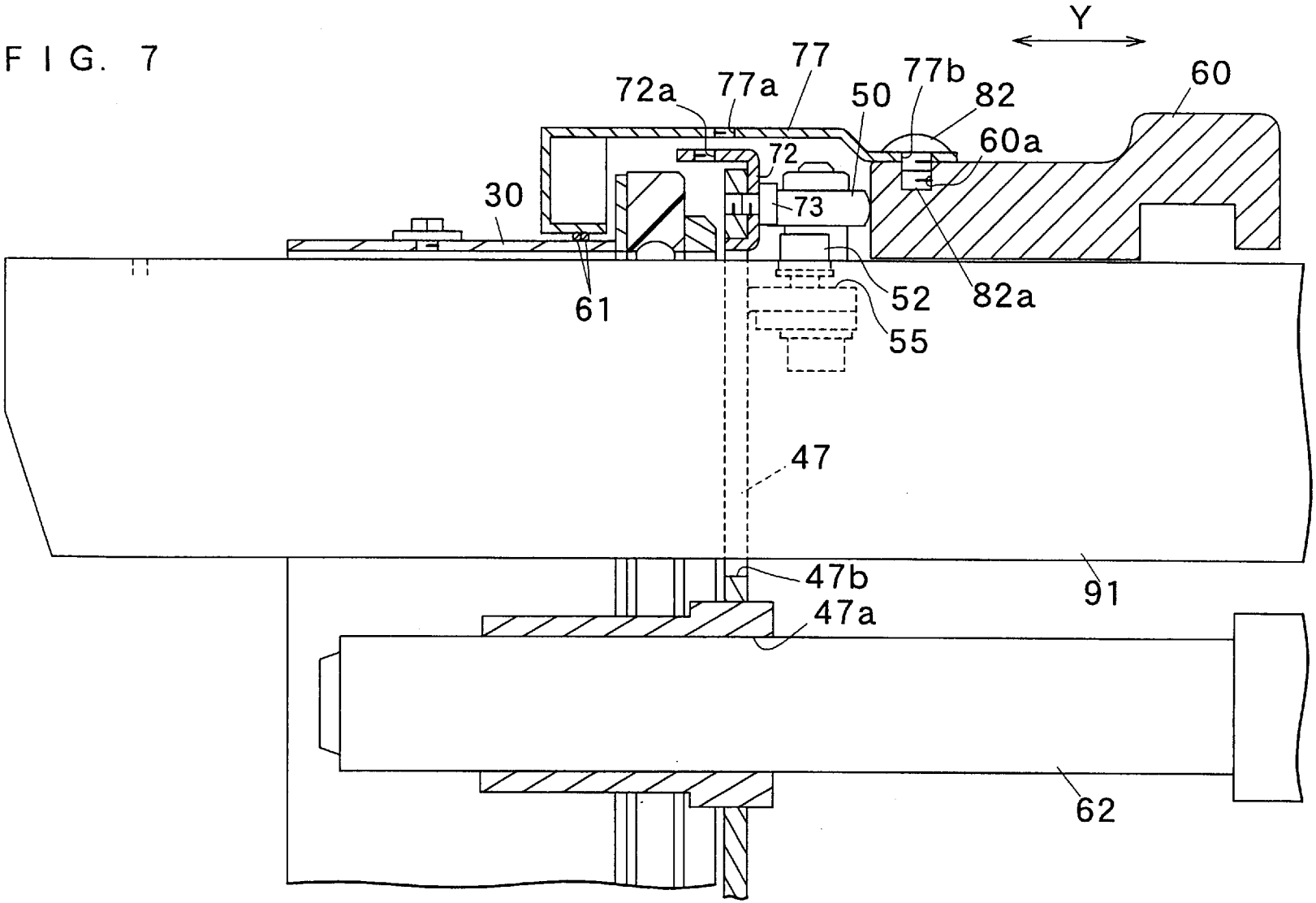
FIG. 7 is a righthand section showing a state in which the same headgear frame apparatus is being attached to or detached from the sewing machine.
Figure 8:
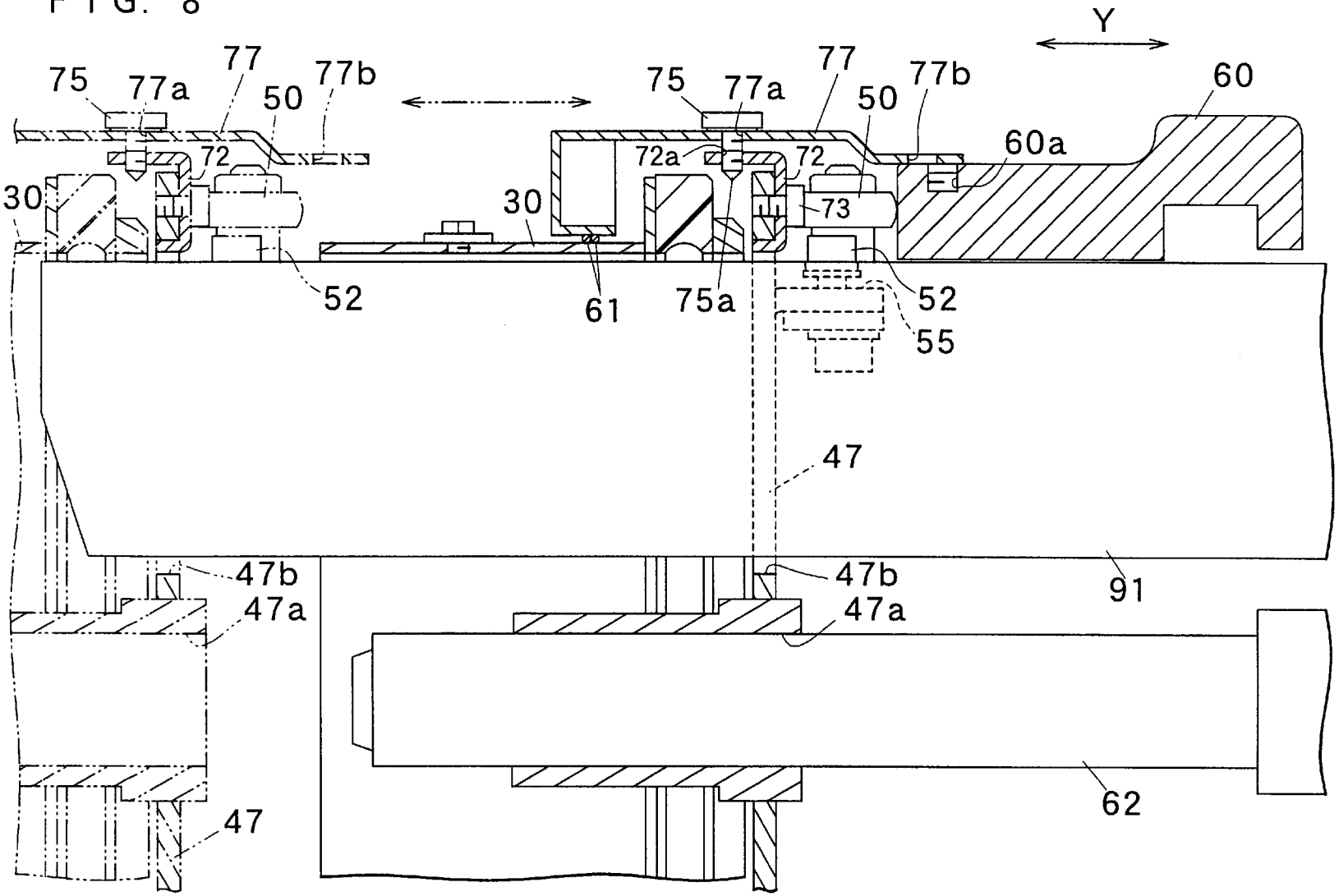
FIG. 8 is a righthand section showing another state in which the same headgear frame apparatus is being attached to or detached from the sewing machine.

The joint member 82 having the connecting function and the temporary connecting member 75 having the connecting function are so constructed that when one of them performs the aforementioned function, the other does not perform the aforementioned function, as will be described in the following. When the externally threaded stem 82*a* of the joint member 82 is inserted into the second joint hole 60*a* and the first joint hole 77*b*, as shown in FIG. 7, the first connecting hole 77*a* and the second connecting hole 72*a* are misaligned so that the externally threaded stem 75*a* of the temporary connecting member 75 cannot be inserted. On the other hand, when the externally threaded stem 75*a* of the temporary connecting member 75 is inserted into the first connecting hole 77*a* and the second connecting hole 72*a*, as shown in FIG. 8, the second joint hole 60*a* and the first joint hole 77*b* are misaligned so that the externally threaded stem 82*a* of the joint member 82 cannot be inserted.

The reason for this construction will be described in the following. If both the joint member 82 and the temporary connecting member 75 are constructed to perform their functions simultaneously, more specifically, the horizontal drive frame 60 and the base member 77 of the transmission mechanism 70 can be connected by the joint member 82, and the base member 77 of the transmission mechanism 70 and the mounting member 72 of the support frame 40 can be connected by the temporary connecting member 75. When the support frame 40, the rotary drive frame 30 and the transmission mechanism 70 (of which the transmission mechanism 70 and the support frame 40 are connected by the temporary connecting member 75) in the removed state are mounted on the horizontal drive frame 60, therefore, the joint member 82 is mounted, but the temporary connecting member 75 may be left unremoved. If the horizontal drive frame 60 is driven with the temporary connecting member 75 being left unremoved, moreover, the headgear frame apparatus 9 and the sewing machine might be damaged.

Figure 9:
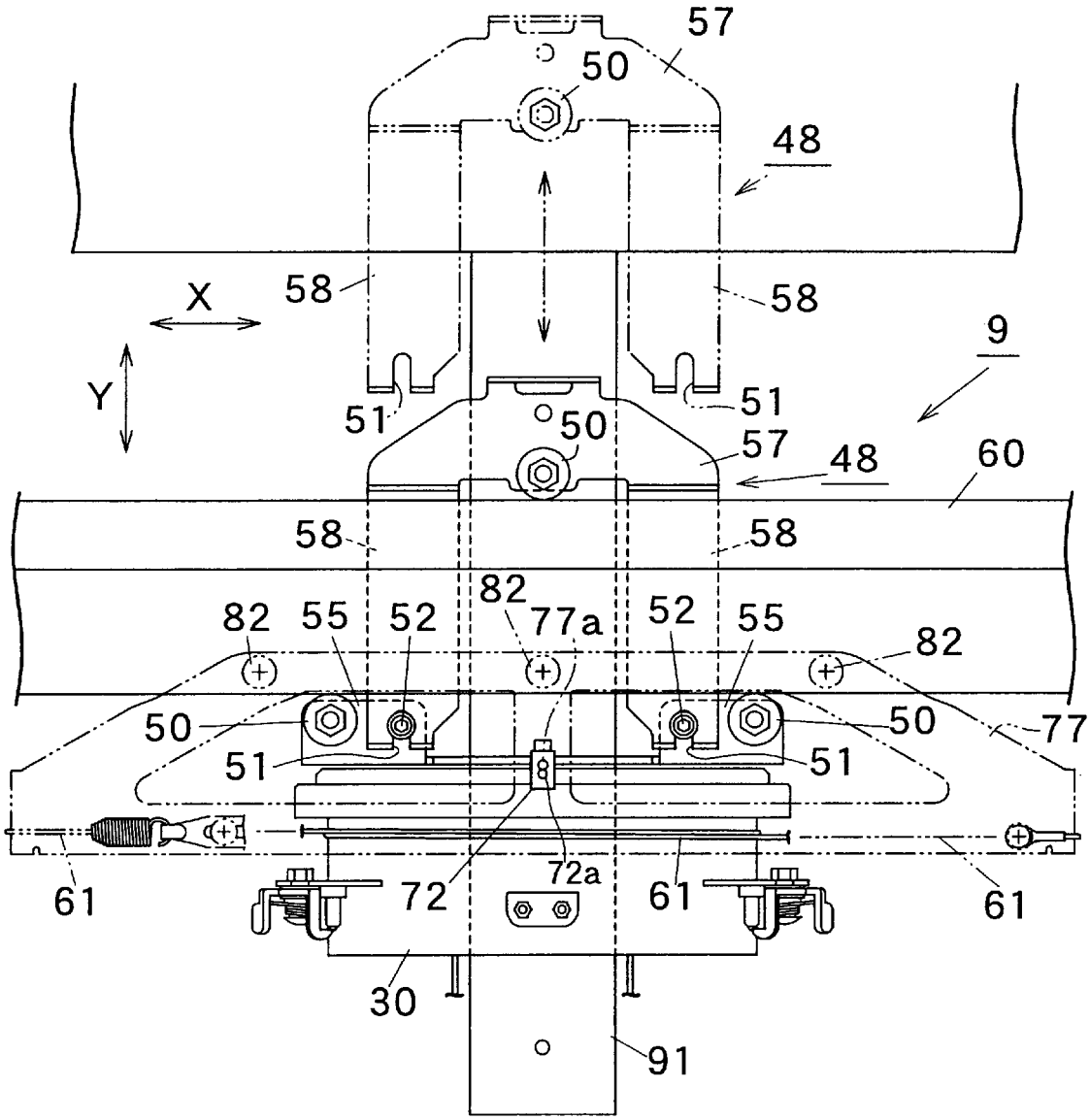
FIG. 9 is a plan view showing still another state in which the same headgear frame apparatus is being attached to or detached from the sewing machine.
Figure 10:
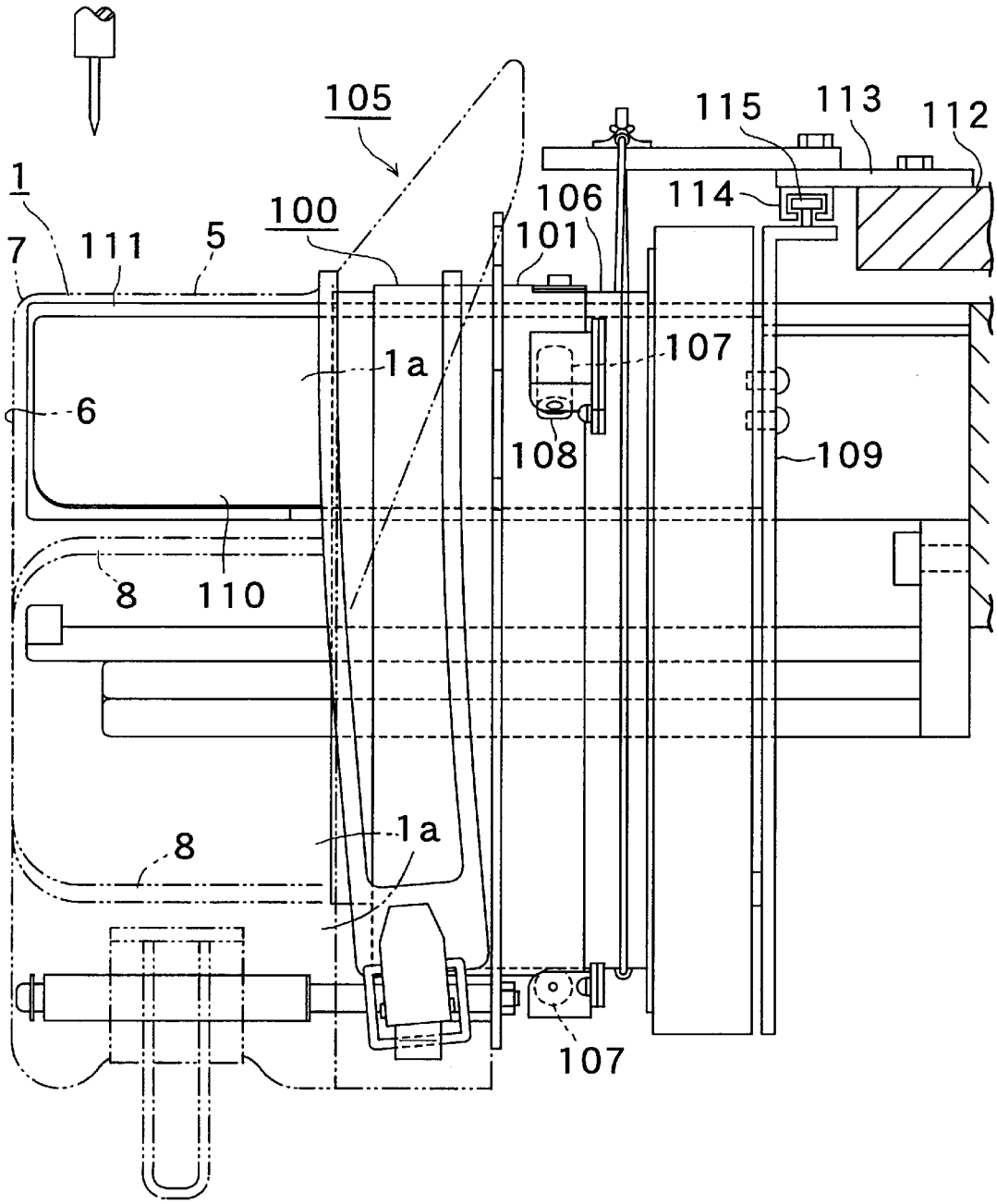
FIG. 10 PRIOR ART
FIG. 10 is a righthand side view showing a first conventional headgear frame apparatus.
Figure 11:
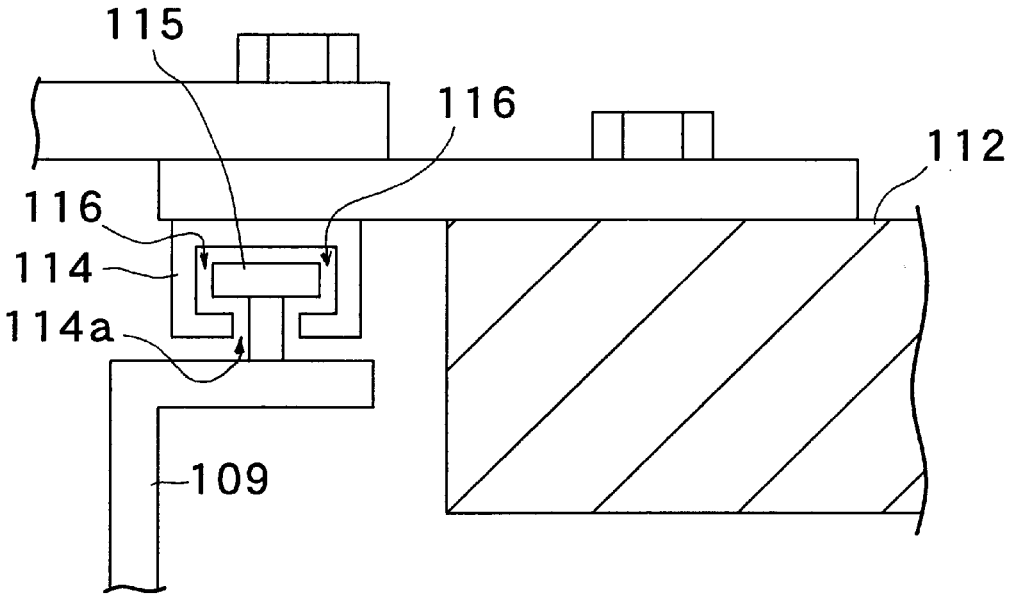
FIG. 11 PRIOR ART
FIG. 11 is an enlarged partial view of FIG. 10.
Figure 12:
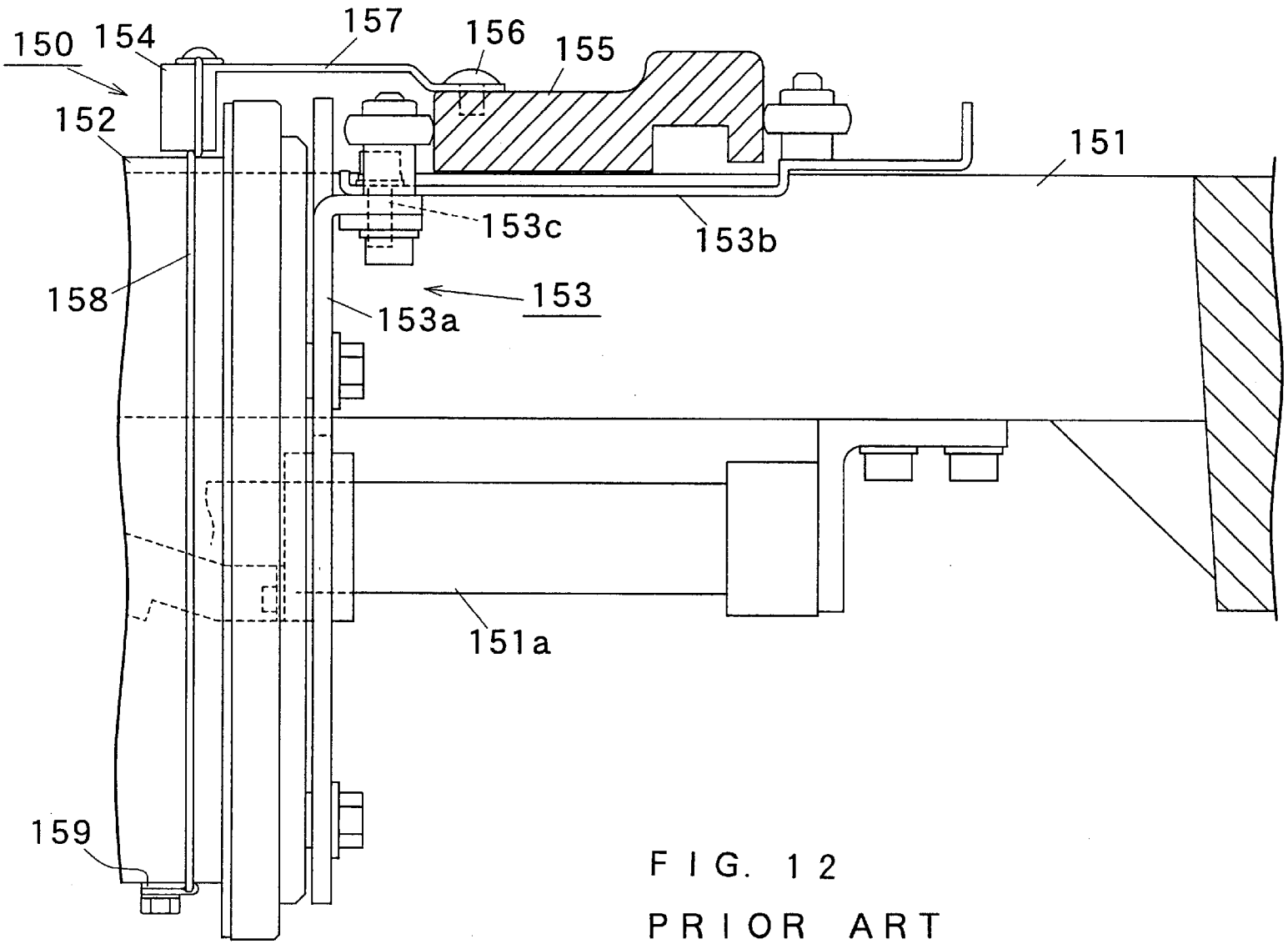
FIG. 12 PRIOR ART
FIG. 12 is a righthand section showing a second conventional headgear frame apparatus of the prior art.

In the headgear frame apparatus 9 thus constructed, the support frame 40, the rotary drive frame 30 and the transmission mechanism 70 are removed from the horizontal drive frame 60 in the following manner. Here, the first connecting hole 77*a* and the second connecting hole 72*a* are misaligned, as shown in FIG. 7, when the support frame 40, the rotary drive frame 30 and the transmission mechanism 70 are mounted on the horizontal drive frame 60:

(1) The joint members 82 are removed from the second joint holes 60*a* and the first joint holes 77*b*. Then, the base member 77 of the transmission mechanism 70 is just connected to the rotary drive frame 30 through the wire 61;

(2) By shifting the position of the base member 77 forward, as shown in FIG. 8, the first connecting hole 77*a* of the base member 77 is aligned in its center axis with the second connecting hole 72*a* of the mounting member 72 of the support frame 40. By inserting the externally threaded stem 75*a* of the temporary connecting member 75 into the first connecting hole 77*a* and the second connecting hole 72*a*, moreover, the transmission mechanism 70 and the support frame 40 are connected;

(3) As shown in FIG. 9, the joint screws 52 are loosened to remove the back side member 48 from the front side member 47. Here, this work (3) may be performed before the aforementioned work (1) or (2); and (4) The support frame 40 is pulled forward, while being held with both hands of the worker, as indicated by a double-dotted line in FIG. 8. Then, the guide rail 62 comes out from the guide hole 47*a*, and the cylindrical bed 91 comes out from the bed hole 47*b*, so that the support frame 40, the rotary drive frame 30 and the transmission mechanism 70 can be removed.

On the other hand, the support frame 40, the rotary drive frame 30 and the transmission mechanism 70 thus removed are mounted on the horizontal drive frame 60 in the following manner:

(1) While the support frame 40 being held with two hands, the guide rail 62 is inserted into the guide hole 47*a*, as indicated by the double-dotted line in FIG. 8, and the cylindrical bed 91 is inserted into the bed hole 47*b*. Then, the support frame 40, the rotary drive frame 30 and the transmission mechanism 70 are pushed in. This push is made so far the front side bearing rollers 49 of the front side member 47 abut against the front face of the horizontal drive frame 60, as indicated by a solid line in FIG. 8. In this state, the second joint holes 60*a* of the horizontal drive frame 60 and the first joint holes 77*b* of the base member 77 of the transmission mechanism 70 are misaligned so that the joint member 82 cannot be mounted;

(2) The temporary connecting member 75 is removed from the first connecting hole 77*a* and the second connecting hole 72*a*. Then, the base member 77 of the transmission mechanism 70 is just connected to the rotary drive frame 30 through the wire 61;

(3) The second joint holes 60*a* and the first joint holes 77*b* are aligned by shifting the base member 77 backward. Then, the base member 77 of the transmission mechanism 70 and the horizontal drive frame 60 are connected, as shown in FIG. 7, by inserting the externally threaded stems 82*a* of the joint members 82 into the first joint holes 77*b* and the second joint holes 60*a*; and (4) As shown in FIG. 9, the back side member 48 is inserted horizontally from the back side of the horizontal drive frame 60 below the horizontal drive frame 60 toward the front side member 47. At this time, the joint screws 52 are fitted in the U-grooves 51 at the leading end portions of the back side member 48. In this state, the horizontal drive frame 60 is clamped (at its front face and back face) by the front side bearing rollers 49 and the back side bearing roller 50, and the joint screws 52 are fastened. Then, the support frame 40, the rotary drive frame 30 and the transmission mechanism 70 can be mounted on the horizontal drive frame 60. Here, this work (4) may be performed before any of the aforementioned works (1) to (3).

According to this headgear frame apparatus 9, there is provided the temporary connecting member 75 which has the function to connect the support frame 40 and the transmission mechanism 70 in the removable manner while substantially holding the positional relation between the support frame 40 and the transmission mechanism 70. When the support frame 40, the rotary drive frame 30 and the transmission mechanism 70 are removed from the horizontal drive frame 60, therefore, it is possible to prevent the support frame 40 and the transmission mechanism 70 from being disintegrated.

On the other hand, the joint members 82 connecting the transmission mechanism 70 and the horizontal drive frame 60 cannot be mounted unless the temporary connecting member 75 connecting the support frame 40 and the transmission mechanism 70 is removed. Thus, the temporary connecting member 75 and the joint member 82 are made to function exclusively from each other. This makes it possible to prevent the temporary connecting member 75 reliably from being left unremoved, when the support frame 40, the rotary drive frame 30 and the transmission mechanism 70 are mounted on the horizontal drive frame 60.

Here, the invention should not be limited to the aforementioned construction of the embodiment but could be embodied by making suitable modifications within the gist thereof, as exemplified in the following:

(1) The joint member 82 or the temporary connecting member 75 is made of a member having joint or connecting method which is different in structure from the externally threaded member; and (2) The construction of the transmission mechanism 70 is modified. This construction may be exemplified by such one as includes a gear formed on the circumferential wall of the rotary drive frame and a rack meshing with said gear and driven by the horizontal drive frame in the direction X.

As many apparently widely different embodiments of this invention may be made without departing from the spirit and scope thereof, it is to be understood that the invention is not limited to the specific embodiments thereof except as defined in the appended claims.

What is claimed is:

1. A headgear frame apparatus, comprising:

a headgear frame for clamping a headgear;

a rotary drive frame for fitting said headgear frame replaceably thereon on the side of a sewing machine;

a horizontal drive frame for applying a rotation and a longitudinal drive to said rotary drive frame through a transmission mechanism; and a support frame engaging in a relative displacement with said horizontal drive frame for supporting said rotary drive frame rotatably, wherein said support frame includes a front side member positioned on the front side of said horizontal drive frame and a back side member positioned on the back side of said horizontal drive frame, said front side member and said back side member are joined by at least one joint member such that said horizontal drive frame is clamped between at least one front side bearing roller mounted rotatably on said front side member and at least one back side bearing roller mounted rotatably on said back side member, said support frame, said rotary drive frame and said transmission mechanism can be removed from said horizontal drive frame when said at least one joint member that joins said transmission mechanism and said horizontal drive frame and said at least one joint member is removed and a temporary connecting member connects said support frame and said transmission mechanism removably while substantially holding a positional relation between said support frame and said transmission mechanism so that said support frame and said transmission mechanism may not be disconnected.

2. A headgear frame apparatus according to claim 1, wherein said front side member and said back side member are joined by inserting at least one joint screw, which is screwed in one of said front side member and said back side member, into at least one U-groove, which is formed in the other, and by fastening said at least one joint screw.

3. A headgear frame apparatus according to claim 1, wherein one of said at least one front side bearing roller and said at least one back side bearing roller is one whereas the other is at least two.

4. A headgear frame apparatus according to claim 2, wherein one of said at least one front side bearing roller and said at least one back side bearing roller is one whereas the other is at least two.

5. A headgear frame apparatus according to claim 1, wherein both of said at least one front side bearing roller and said at least one back side bearing roller are at least two.

6. A headgear frame apparatus according to claim 2, wherein both of said at least one front side bearing roller and said at least one back side bearing roller are at least two.

7. A headgear frame apparatus, comprising:

a support frame for rotatably supporting a rotary drive frame for fitting a headgear frame for clamping a headgear replaceably thereon;

a transmission mechanism for transmitting a driving force to said rotary drive frame; and a horizontal drive frame for driving said rotary drive frame longitudinally through said support frame and for driving said rotary drive frame rotationally through said transmission mechanism, so that said support frame, said rotary drive frame and said transmission mechanism can be removed from said horizontal drive frame when at least one joint member that joins said transmission mechanism and said horizontal drive frame is removed, wherein a temporary connecting member connects said support frame and said transmission mechanism removably while substantially holding a positional relation between said support frame and said transmission mechanism so that said support frame and said transmission mechanism may not be disconnected.

8. A headgear frame apparatus according to claim 7, wherein when one of said temporary connecting member and said joint member connects, the other does not connect.

9. A headgear frame apparatus according to claim 8, wherein said joint member includes a joint stem adapted to be inserted into first joint hole formed in said transmission mechanism and second joint hole formed in said horizontal drive frame, said temporary connecting member includes a connecting stem adapted to be inserted into a first connecting hole formed in said transmission mechanism and a second connecting hole formed in said support frame, when the joint stem of said joint member is inserted in said first joint hole and said second joint hole, said first connecting hole and said second connecting hole are misaligned so that the connecting stem of said temporary connecting member cannot be inserted in them, and when the connecting stem of said temporary connecting member is inserted into said first connecting hole and said second connecting hole, said first joint hole and said second joint hole are misaligned so that the joint stem of said joint member cannot be inserted in them.

* * * * *